US006691829B1

(12) United States Patent
Stelmach

(10) Patent No.: US 6,691,829 B1
(45) Date of Patent: Feb. 17, 2004

(54) GUTTER GUARD

(76) Inventor: John J. Stelmach, 740 6th St., Prescott, AZ (US) 86301

( * ) Notice: Subject to any disclaimer, the term of this patent is extended or adjusted under 35 U.S.C. 154(b) by 0 days.

(21) Appl. No.: 10/121,275

(22) Filed: Apr. 12, 2002

(51) Int. Cl.[7] ..... E06C 7/00; E04G 5/02; E04D 13/00

(52) U.S. Cl. ..... 182/214; 182/107; 52/11

(58) Field of Search ..... 182/214, 107, 182/229, 129; 52/11–16; 248/48.1, 48.2, 238

(56) References Cited

U.S. PATENT DOCUMENTS

| | | | | | |
|---|---|---|---|---|---|
| 2,203,445 | A | * | 6/1940 | Schwarz et al. | 182/214 X |
| 2,407,541 | A | * | 9/1946 | Ehnborn | 182/214 |
| 3,713,510 | A | * | 1/1973 | O'Dell | 182/107 X |
| 3,853,202 | A | * | 12/1974 | Jarboe | 182/214 X |
| 3,915,418 | A | | 10/1975 | D'Amato | |
| 4,185,421 | A | | 1/1980 | Robinson | |
| D284,832 | S | | 7/1986 | Parker | |
| 4,601,365 | A | | 7/1986 | Davis | |
| 4,714,136 | A | | 12/1987 | Morin | |
| 4,813,515 | A | | 3/1989 | Wigington | |
| 5,169,098 | A | | 12/1992 | Samuelson | |
| 5,215,163 | A | | 6/1993 | Kent, Sr. et al. | |
| 5,242,031 | A | * | 9/1993 | Ashley | 182/214 |
| 5,279,389 | A | * | 1/1994 | Crockett | 182/214 |
| 5,358,071 | A | * | 10/1994 | Stennett | 182/214 |
| 5,497,848 | A | * | 3/1996 | Travis | 182/107 |
| 5,549,261 | A | | 8/1996 | Hardin | |
| 5,628,381 | A | * | 5/1997 | Markovich et al. | 182/107 |
| 5,775,465 | A | * | 7/1998 | Vossler | 182/214 |
| 6,019,191 | A | * | 2/2000 | Flores | 182/107 |
| 6,029,774 | A | | 2/2000 | Cothern | |

FOREIGN PATENT DOCUMENTS

| | | |
|---|---|---|
| WO | WO 93/25793 | 12/1993 |

* cited by examiner

*Primary Examiner*—Hugh B. Thompson
(74) *Attorney, Agent, or Firm*—Parsons & Goltry; Michael W. Goltry; Robert A. Parsons

(57) ABSTRACT

A combination gutter protector and safety device for use with a ladder which is leaned against the upper part of a structural wall that is equipped with a rain gutter under the eaves. The device is secured to the fascia board of the wall in a longitudinal plane adjacent to or substantially even with the plane of the open top of the gutter in such position that it protects the gutter against deformation when the ladder is put in place. The device also serves to provide a contained recess for holding the ladder against slippage and, if desired, locking the ladder against theft. The structure of the device accomplishes the above purposes without occupying any part of the channel of the gutter and thus does not interfere with the free flow of water, leaves and other debris in the channel of the gutter.

16 Claims, 8 Drawing Sheets

FIGURE 2
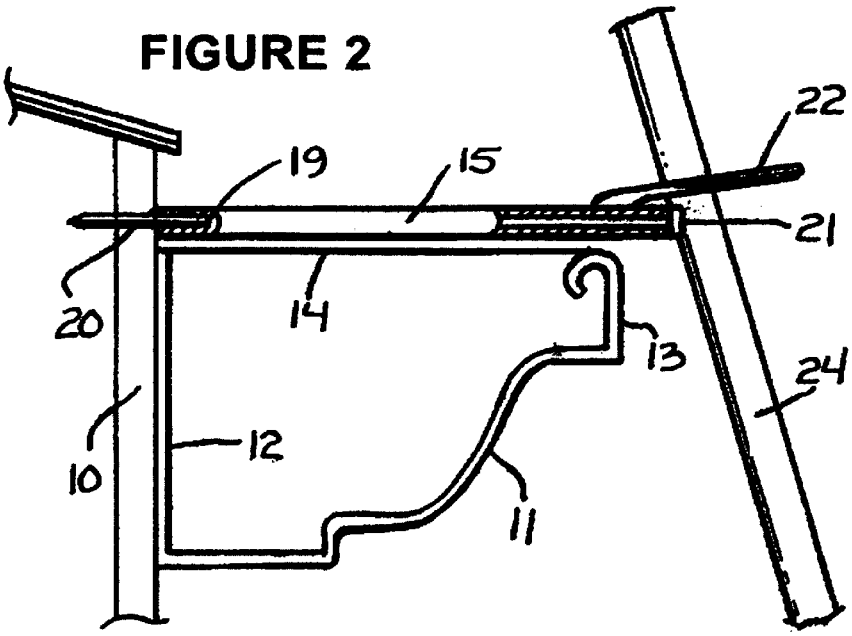
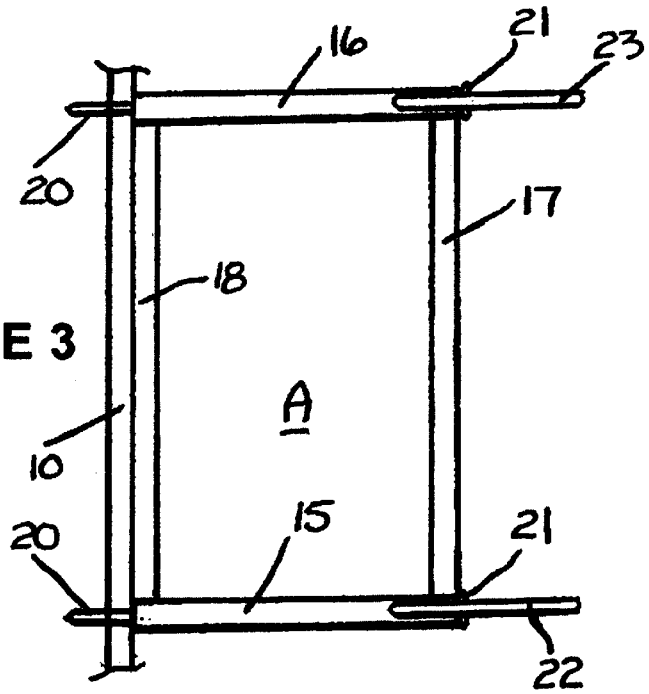
FIGURE 3

GUTTER GUARD

BACKGROUND OF THE INVENTION

This invention relates to an improved device for supporting a ladder against a building structure, and more particularly to an improved ladder support which is mounted on the fascia board of a structure to prevent gutter deformation from contact by the ladder.

When a person desires to reach the roof of a house, the usual procedure is to place a ladder in position against the wall or an eave of the roof. If a rain gutter is in place below the eave, the ladder is usually placed against the gutter. Because of the relative weakness of the construction of a gutter, the weight of the ladder and of the person ascending such ladder create a risk of damaging the gutter. Further, because the relatively narrow surfaces of the rails of the ladder rest against the relatively narrow, horizontally extending surface of the outer edge of the gutter, the person ascending the ladder faces the risk of ladder slippage and a consequently serious fall. Accordingly, there exists in the art a need for a gutter guard that is adapted to bear the weight of the ladder and resist slippage and at the same time avoid interference with the intended purpose of the gutter.

A number of devices have been proposed in the prior art for dealing with the above problems. For example, the patents to Robinson, U.S. Pat. No. 4,185,421, and Kent et al, U.S. Pat. No. 5,215,163, disclose pairs of spaced legs extending outwardly from the fascia board, with crossbars against which the weight of the ladder may rest. However, in such arrangements the guard apparatus occupies a considerably lower portion of the inner channel of the gutter and thus interferes with the free flow of water, leaves and other debris along the interior of the gutter. Other patents which address the above problems in other ways include the patents to Hardin, U.S. Pat. No. 5,549,261; Morin, U.S. Pat. No. 4,714,136; D'Amato, U.S. Pat. No. 3,915,418; Wigington, U.S. Pat. No. 4,8813,515; and Samuelson, U.S. Pat. No. 5,169,098.

SUMMARY AND OBJECTS OF THE INVENTION

It is an object of the present invention to provide a gutter guard framework which is attached to the fascia board at a level substantially even with the plane of the upper edge of the gutter, for bearing the load of the ladder and its occupant, without interfering with the normal function of the gutter.

It is another object of the invention to provide a gutter guard framework which utilizes restraining spurs to prevent sideways slippage of the ladder when it is in place.

It is a further object to provide a guard framework which also prevents the ladder from inadvertently falling backwards away from the building while its occupant is in position on the ladder or ascending or descending the roof area.

It is a still further object to provide means for locking the ladder in place, to prevent theft of the ladder in the event the workman finds it necessary to leave the ladder unattended for a period of time.

Another object is to provide ladder locator means for marking the spot or spots which have been designated for safe access to the roof.

Other objects and a fuller understanding of the invention will become apparent as the specification proceeds.

In accordance with the invention as embodied and broadly described herein, the foregoing and other objects are achieved by providing a ladder support comprising a frame attached to the building fascia in a longitudinal plane above or substantially even with the plane of the open top of the gutter, said frame having two side legs, and a front leg at the front side of said gutter, for supporting the ladder, each of said side legs having a longitudinal passageway therethrough adapted to receive a screw or spike for fastening said side legs to said fascia board above or substantially even with the open top of said gutter, and each of said side legs having spurs extending beyond the free ends thereof for preventing slippage of said ladder when it is in place against said front leg.

In a specific embodiment, the said spurs have apertures in their free ends for receiving a retention rod for preventing the ladder from falling away from said structure. In a further embodiment, means are provided for storing and locking the retention rod in place until its purpose has been served.

In all embodiments, the members of the guard assembly are positioned at a level above or substantially even with the plane of the top edge of the gutter, so that there is no interference with the free flow of water, leaves and other debris through the channel of the gutter.

BRIEF DESCRIPTION OF THE DRAWINGS

In order to more fully understand the manner in which the above-recited and other advantages and objects of the invention are obtained, a more particular description of the invention will be rendered by reference to specific embodiments thereof which are illustrated in the appended drawings. Understanding that these drawings depict only typical embodiments of the invention and are not therefore to be considered to be limiting in scope, the invention in its presently understood best mode for making and using the same will be described and explained with additional specificity and detail through the use of the accompanying drawings in which:

FIG. 2 is a side view taken along the 2—2 line of FIG. 1.

FIG. 3 is a top view of the gutter guard framework shown in FIG. 1.

DESCRIPTION OF THE PREFERRED EMBODIMENTS OF THE INVENTION

Figure 1:
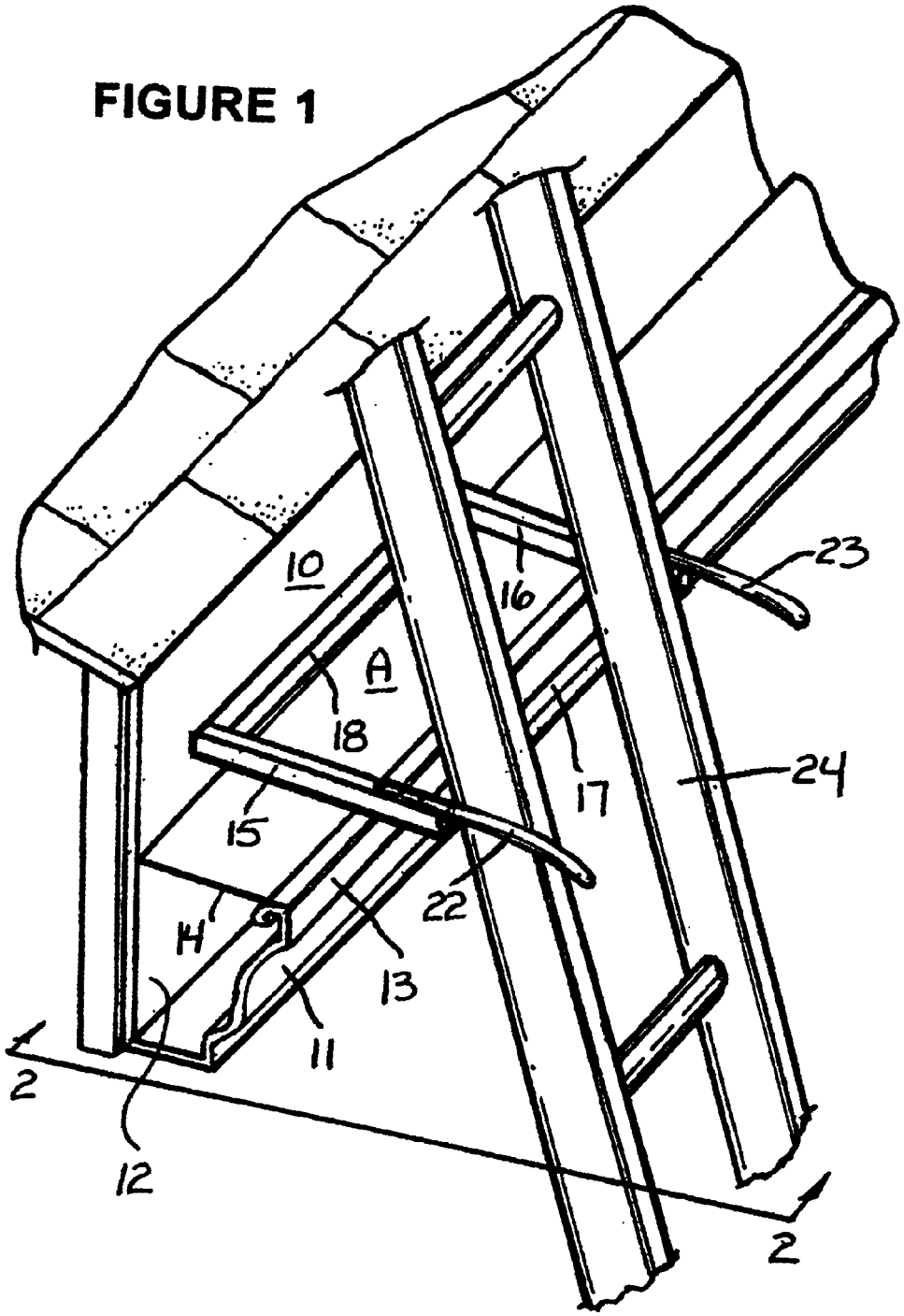
FIG. 1 is a perspective view showing one embodiment of the invention in use.

As illustrated in FIGS. 1 and 3, the invention is based on the use of a gutter guard frame generally indicated by the letter A. The frame A is attached to a fascia board 10 above the top of a gutter 11 that is also attached to the fascia board 10. As shown, the gutter has a back side 12 that is attached to the fascia board 10, a front side 13, and an open top, the horizontal plane of which is indicated by the numeral 14. The gutter guard frame A is made up of a pair of side legs 15 and 16, which are connected by a front leg 17. The frame A may also have a back leg 18, which is not an essential element, but which is preferred for reinforcement purposes. As shown in FIGS. 2 and 3, each of side legs 15 and 16 is a hollow tube providing a longitudinal passageway 19 through which a spike 20, having a head 21, is driven into the fascia board 10 to attach each of the side legs 15 and 16 to the fascia board. Instead of a spike, the element 20 may also be a long screw, which may be screwed into the fascia board to attach the side legs 15 and 16 to the board.

Attached on the tops of side legs 15 and 16, extending outwardly from their outward ends, are extensions or spurs 22 and 23. The space delineated by spurs 22 and 23 and the front leg 17 of the frame A forms a recess, which is adapted to receive a ladder 24. As shown in the embodiment of FIGS. 1 and 2, the front leg 17 is positioned outwardly beyond the front side 13 of the gutter 11, and accordingly a ladder 24 positioned in the above recess will lean its weight against the front leg 17 of the frame A rather than against the gutter 11, thereby protecting the gutter from disfiguration or other damage. Further, the spurs 22 and 23 prevent sideways slippage of the ladder 24. At the discretion of the installer, the spikes or screws 20 may be driven into the fascia board 10 in a perpendicular fashion, to make an angle of approximately 90 degrees between the side legs 15 and 16 and the fascia board 10; or, if desired, the spikes may be driven at a somewhat greater angle (e.g., 90 to 110 degrees), in order to effect an angle of approximately 90 degrees between the side legs 15 and 16 and the leaning ladder 24.

As will be seen from the above, the gutter guard framework shown in FIGS. 1–3 provides the desired protection of the gutter and the prevention of ladder slippage while at the same time maintaining the interior channel of the gutter (that is, the portion below the top plane 14 of the gutter 11) free of any part of the gutter guard framework, thus ensuring that there is no obstruction to the free flow of water, leaves and other debris through the gutter channel.

Figure 4:
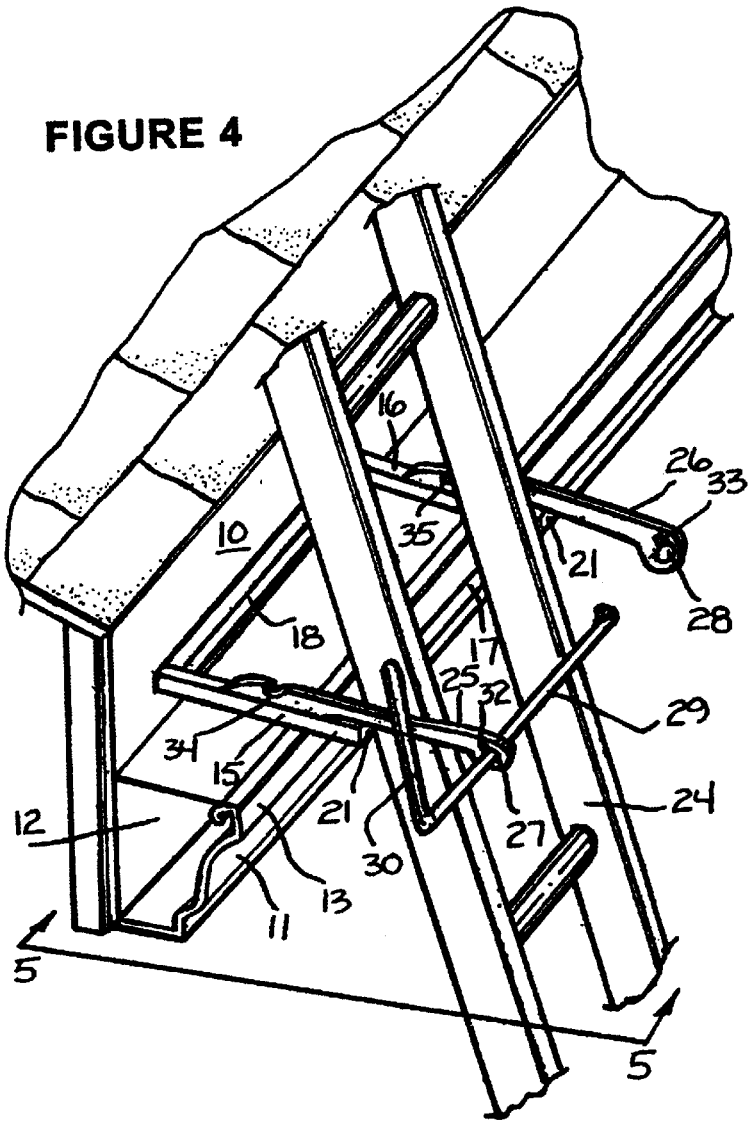
FIG. 4 is a perspective view showing an alternate embodiment of the invention.
Figure 5:
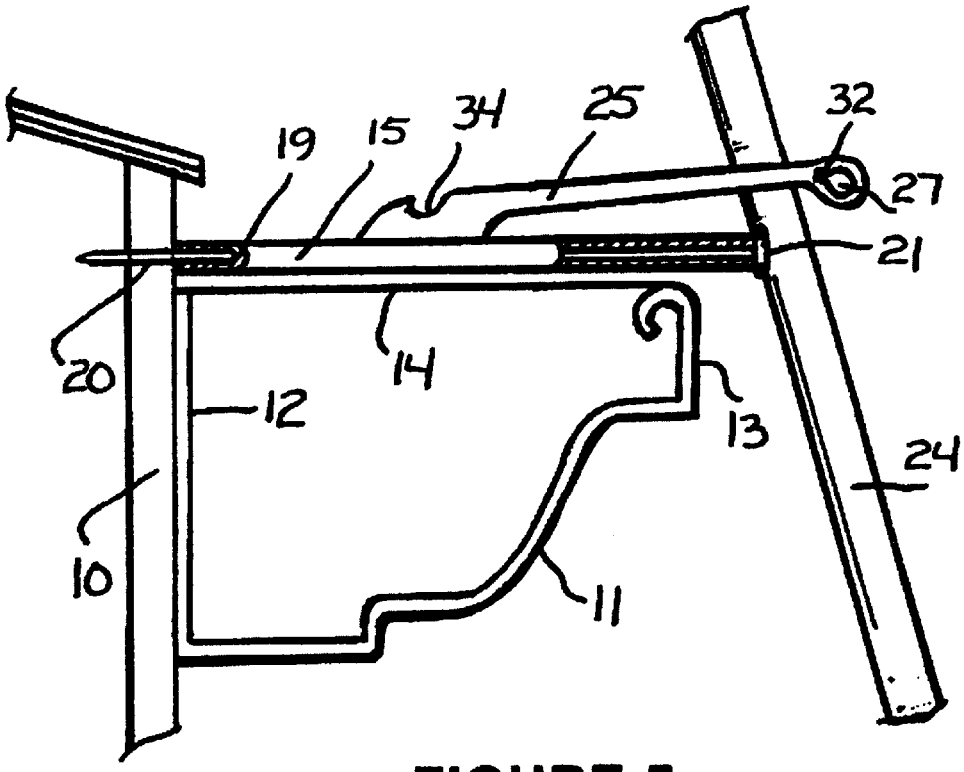
FIG. 5 is a side view taken along the 5—5 line of FIG. 4.
Figure 6:
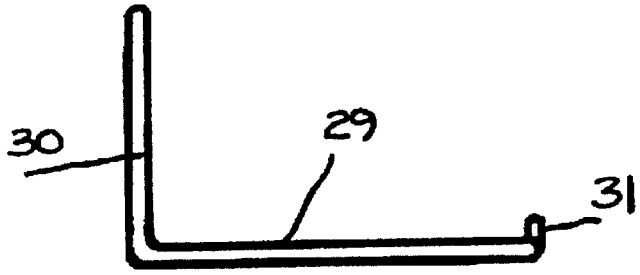
FIG. 6 is a plan view of a retention rod for use in connection with the embodiment shown in FIGS. 4 and 5.
Figure 7:
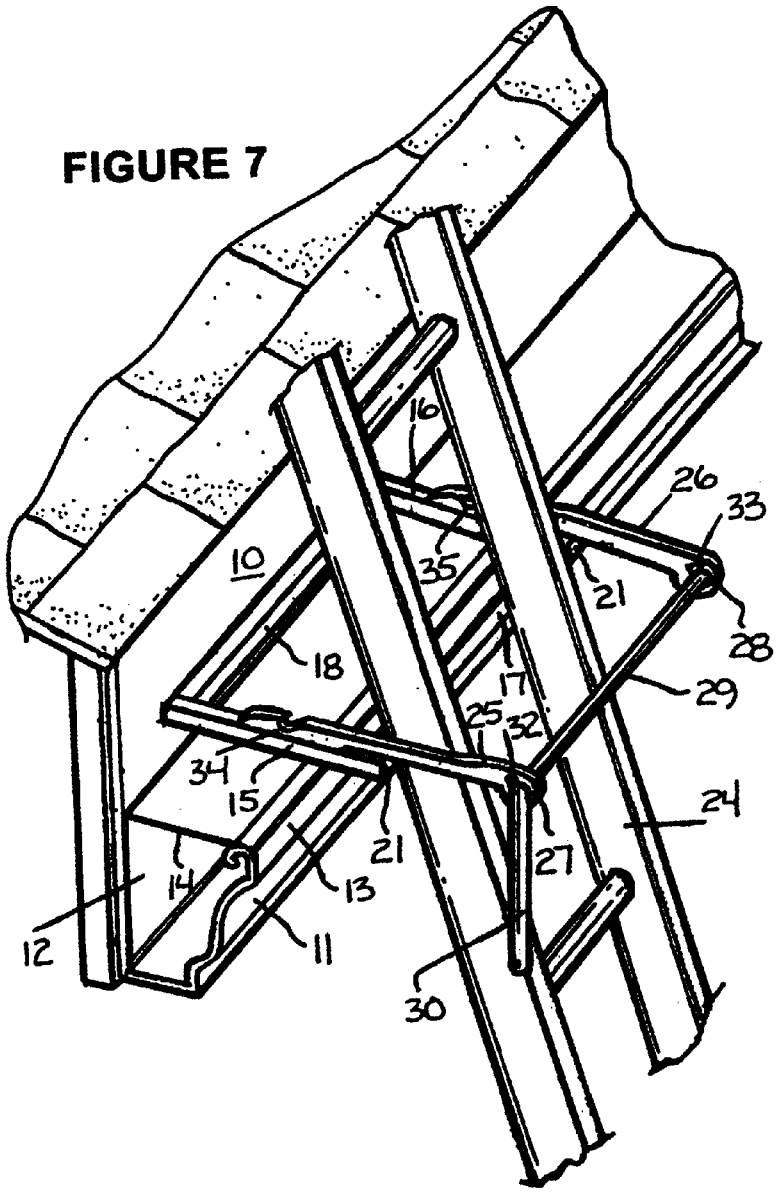
FIG. 7 is a perspective view of the embodiment shown in FIGS. 4–6, showing the retention rod inserted in the apertures of the spurs.

FIGS. 4–8 show another embodiment of the invention, in which the spurs 22 and 23 are replaced with revised spurs 25 and 26, in which apertures 27 and 28 are provided in the outer ends for receiving a retention rod 29. As shown in FIGS. 4 and 6, the retention rod has a handle 30 at one end and a key nub 31 at the other. Preferably, the handle 30 and the key nub 31 are substantially in the same plane. At the stage of assembly shown in FIG. 4, the end of the retention rod 29 bearing the key nub 31 has been inserted through the aperture 27 in spur 25 and is being guided toward insertion through the aperture 28 in spur 26. Both apertures 27 and 28 are fitted with key raceways 32 and 33, respectively, and in order to thread the retention rod 29 through apertures 27 and 28 it is necessary that handle 30 be turned so that the key nub 31 mates with key raceways 32 and 33. When the retention rod 29 has been fully inserted through both apertures 27 and 28 as above, the handle 30 may be allowed to drop by the force of gravity to the position shown in FIG. 7. At this point, the key nub 31 has also been dropped down out of mating relationship with the key raceway 33 and has thereby been locked by the force of gravity against accidental removal. The ladder 24 thus has been captured against sideways motion by the spurs 25 and 26, and against outward movement by the locked retention rod 29.

Figure 8:
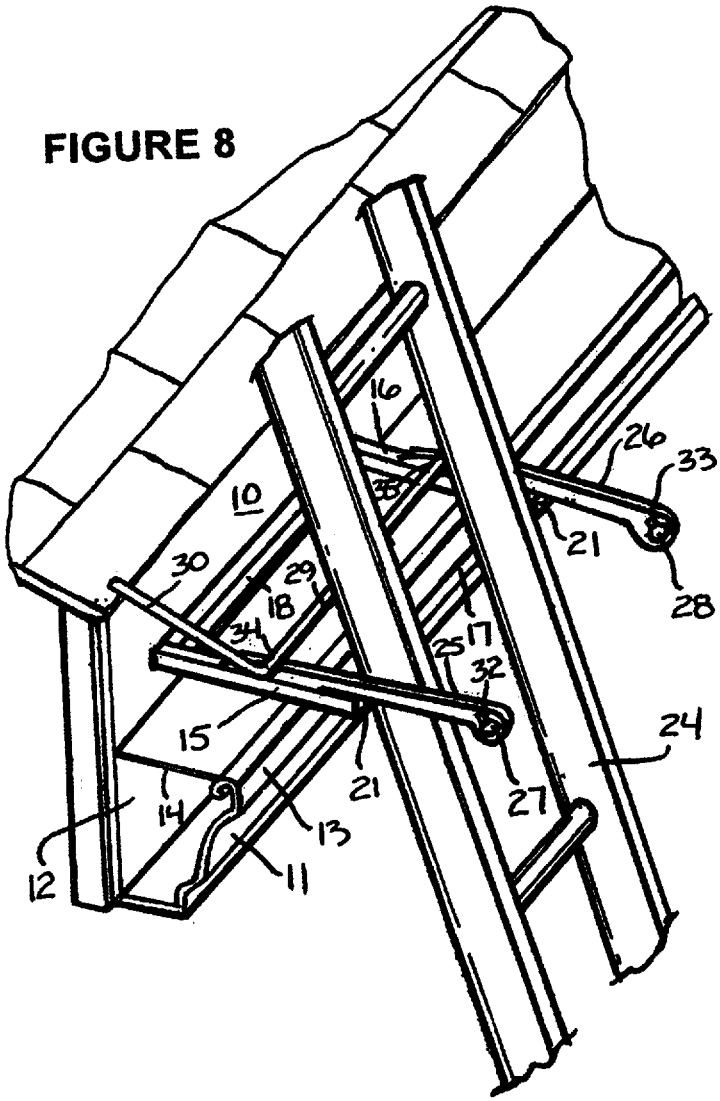
FIG. 8 is a perspective view of the embodiment shown in FIGS. 4–7, showing the retention rod in storage when not in use.
Figure 9:
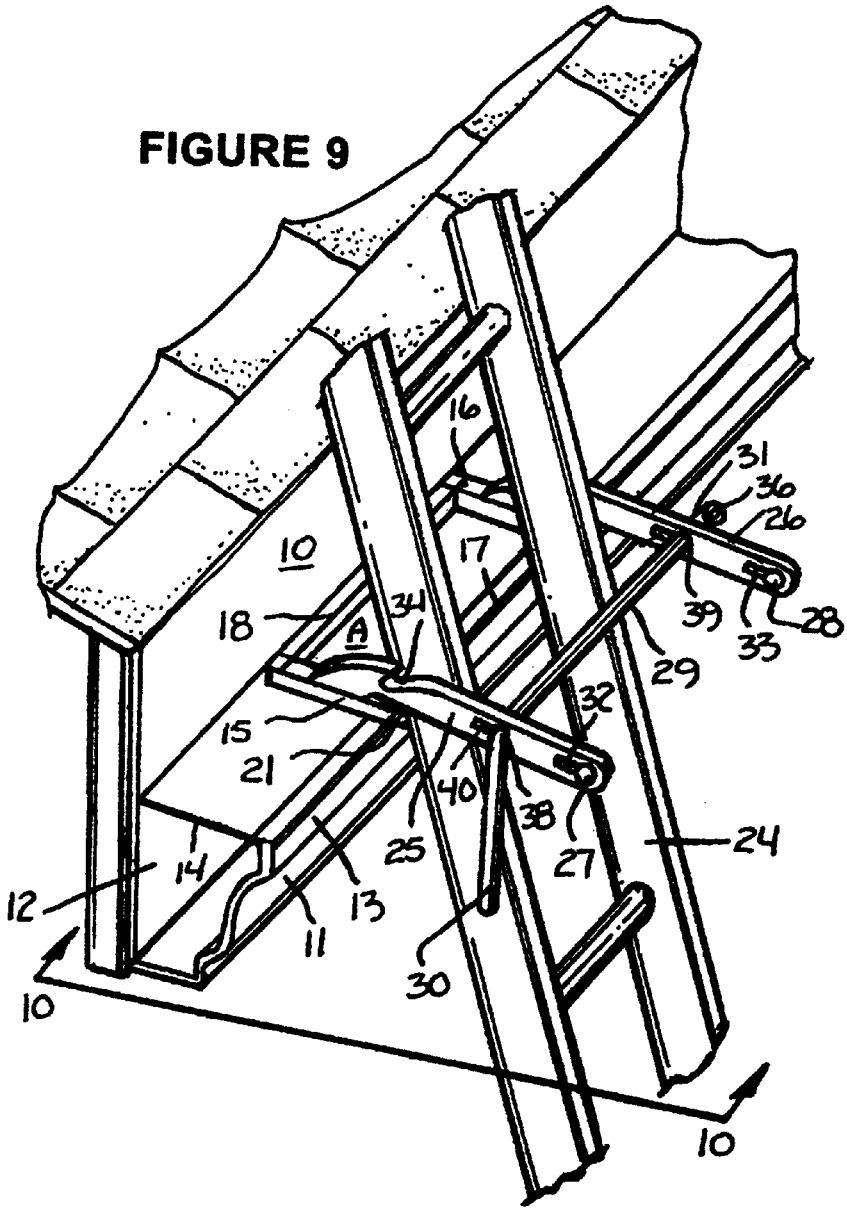
FIG. 9 is a perspective view showing an embodiment of invention in which the guard assembly is positioned in a plane substantially even with the plane of the top of the gutter.

When the ladder is ready to be removed, the retention rod 29 can be removed by turning the handle to the position shown in FIG. 4, so that the key nub 31 mates with the key raceway 33 and can be pulled out through aperture 28 in spur 26 and then through aperture 27 in spur 25. When the retention rod 29 has served its purpose in this manner, it can be stored for future use by placing in the storage slots 34 and 35, as shown in FIG. 8, where the handle 30 is pivoted to lean against the fascia 10 or the roof line, where it is out of sight and does not constitute an obstruction within the channel of the gutter 11.

As will be apparent from the above, the cage formed by the front leg 17, the spurs 25 and 26, and the retention rod 29 prevent any ladder disposed in said cage from moving laterally or outwardly. Furthermore, the load of the ladder itself and any load carried by the ladder is transferred directly from the ladder through the gutter guard frame A to the fascia board 10 and is never applied directly or indirectly to the gutter 11. The front leg 17 protrudes beyond the outer edge 13 of the gutter 11 and spaces the ladder apart from the outer edge 13 of the gutter 11 to prevent any possible application of the load of the ladder itself against the gutter 11.

In addition to preventing deformation of the gutter, and retaining the ladder against lateral or outward motion, the gutter guard of the present invention also serves as a ladder locator, for marking the place or places that the building constructor has designated as safe for the use of a ladder.

Figure 10:
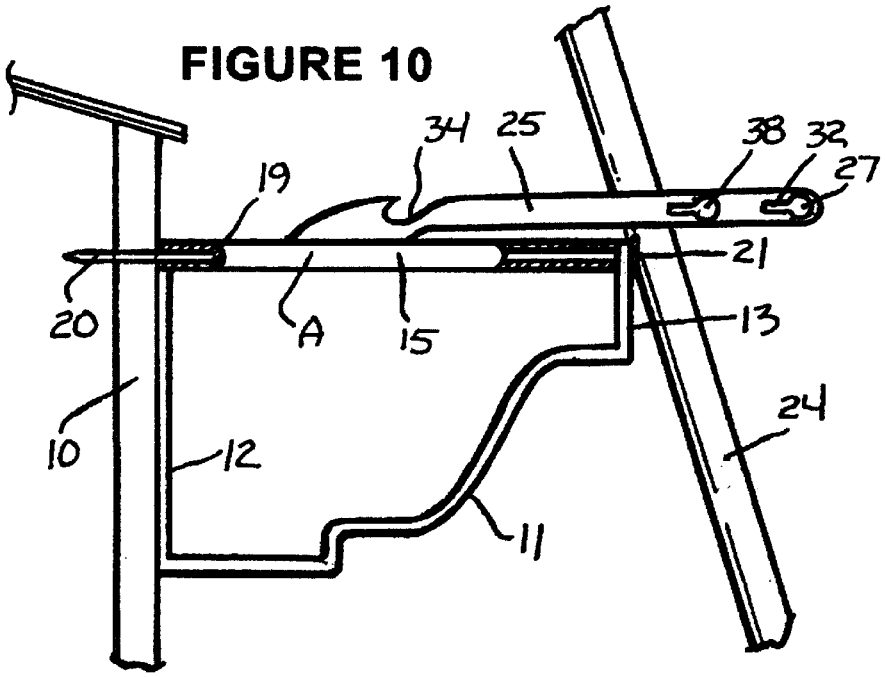
FIG. 10 is a side view taken along line 10—10 of FIG. 9.

FIGS. 9–12 show another embodiment of the invention in which the gutter guard frame A is moved to a less conspicuous position, so that persons viewing the house or structure from the street level see little or nothing of the gutter guard framework. In this embodiment, the frame A is placed inside the gutter 11 immediately below the horizontal top plane 14 of the gutter. As shown in FIG. 10, the side legs 15 and 16 are hollow tubes providing a longitudinal passageway 19 through which the spike or screw 20, having a head 21, is driven through the fascia board 10 to attach each of the side legs 15 and 16 to the fascia board. Although the gutter guard frame is thus substantially hidden from view, it occupies only a minimal portion of the upper interior of the gutter at the horizontal top plane. It is substantially even with the horizontal top plane of the gutter and does not interfere with the flow of water, leaves an other debris through the gutter. The front leg 17 of the frame A supports the upper edge of the gutter 11 from the inside, and when a ladder 24 is placed against the outside top edge of the gutter, the support of front leg 17 prevents the gutter from being deformed.

The embodiment shown in FIGS. 9–12 has the further feature of two added apertures 38 and 39, on the spurs 25 and 26, respectively, so that the position of the retention rod 29 may be adjusted to accommodate ladders of differing thickness. Both apertures 38 and 39 are fitted with key raceways 40 and 41. If an extension ladder is being used, the portion of the ladder that contacts the gutter may be only a single extension, or it may be at a point where overlapping extensions occur, and the occupant of the ladder may use either the apertures 27 and 28 or the apertures 38 and 39 to adjust the position of the retention rod 29 for either of these differing thicknesses.

Figure 11:
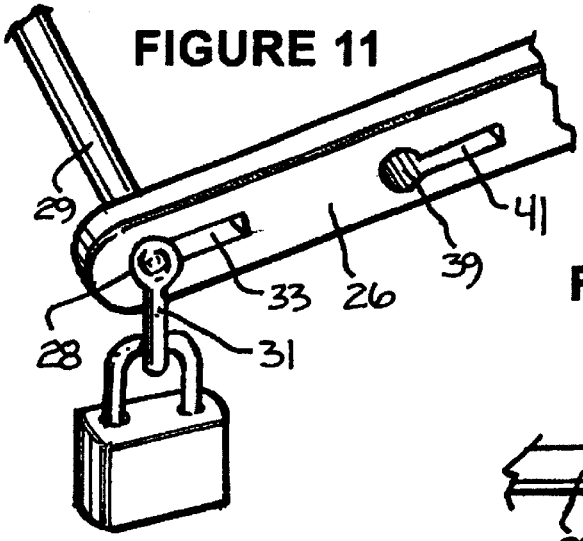
FIG. 11 is an enlarged perspective view showing a means of padlocking the retaining rod of FIG. 9 in place.
Figure 12:
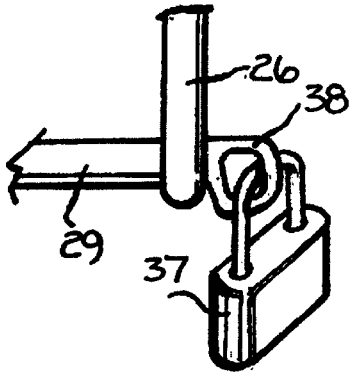
FIG. 12 is a further enlarged front view showing the padlocking means of FIG. 11.

In the embodiment shown in FIGS. 9–12, the retention rod 29 is fitted with a key nub 31 that is in the form of a ring or washer 36 which allows a padlock 37 to be used to lock the retention rod 29 in place and thus prevent theft of the ladder in the event the occupant finds it necessary to leave the ladder unattended for a period of time. As shown in FIGS. 11 and 12, the ring or washer 36 may be welded or otherwise attached to the end of the key nub 31. When the retention rod 29 is threaded through the apertures 27 and 28, or through the apertures 38 and 39, and the handle 30 is allowed to drop so that the key nub 31 is dropped down out of mating relationship with the key raceway 33 or 41, the ring or washer 36 is available in the form of an eyelet for mating with a padlock 37, and the ladder is thus locked in place.

The present invention may be embodied in still other specific forms without departing from its spirit or essential characteristics. The described embodiments are to be considered in all respects only as illustrative and not restrictive. The scope of the invention is, therefore, indicated by the appended claims rather than the foregoing description. All changes which come within the meaning and equivalency of the claims are to be embraced within their scope.

What is claimed is:

1. A ladder support for spacing a ladder from a fascia board of a structure having a gutter, said gutter having a back side adapted to be fastened to said fascia board, an opposing front side, a bottom side, and an open top, said ladder support comprising a frame attachable to said fascia board in a longitudinal plane substantially adjacent the open top of said gutter, said frame having two side legs, and a front leg extending along the front side of said gutter, for supporting said ladder, each of said side legs having a longitudinal passageway there through adapted to receive a spike or screw for fastening said side legs to said fascia board above the open top of said gutter, and each of said side legs having free ends and having spurs having free ends extending beyond the free ends of said legs for preventing slippage of said ladder when it is in place between said spurs, wherein said spurs have apertures in their free ends for receiving a retention rod, having two ends, for preventing the ladder from falling away from said structure.

2. The ladder support of claim 1 wherein said spurs have slots for storing said retention rod when not in use.

3. The ladder support of claim 1 wherein said retention rod has a key nub at one end and said apertures in the said free ends of said spurs have key raceways which can mate with said key nub, so that said retention rod can be inserted in said apertures and locked in place by turning said rod.

4. The ladder support of claim 3 wherein an end of said retention rod opposite said key nub is equipped with a handle extending away from said retention rod in substantially the same plane as said key nub.

5. The ladder support of claim 4 wherein said retention rod is locked in place by the force of gravity on said handle.

6. The ladder support of claim 1 wherein said frame is positioned in a substantially horizontal plane adjacent to, but above, the open top of said gutter.

7. The ladder support of claim 1 wherein said frame is positioned in a horizontal plane substantially even with the open top of said gutter.

8. A structural system including means for indicating a ladder location or for protecting a part of a building structure having a fascia board and a roof against deformation when a ladder is used for access to the roof of said structure, said device comprising:

a) a fascia board of a building structure;

b) a ladder support comprising a frame attached to said fascia board in a longitudinal plane said frame having two side legs, and a front leg extending outwardly for supporting said ladder, each of said side legs having a longitudinal passageway therethrough adapted to receive a spike or screw for fastening said side legs to said fascia board said, side legs having free ends and spurs having free ends extending beyond the free ends of said legs for preventing slippage of said ladder when it is in place against said front leg;

c) said spurs having apertures in their free ends for receiving a retention rod having two ends for preventing the ladder from falling away from said structure, and said spurs having slots for storing said retention rod when not in use; and d) said retention rod having a key nub at one end and said apertures in said free ends of said spurs having key raceways which can mate with said key nub, so that said retention rod can be inserted in said apertures and locked in place by turning said rod.

9. The structural system of claim 8 wherein an end of said retention rod opposite said key nub is equipped with a handle and said retention rod is locked in place by the force of gravity on said handle.

10. The structural system of claim 8 wherein each of said spurs has at least two spaced apart apertures for receiving said retention rod at varying positions to accommodate ladders of differing thickness.

11. The structural system of claim 8 wherein said key nub on said retention rod is in the form of an eyelet for use with a means for locking said retention rod in place.

12. The structural system of claim 8 wherein said key nub on said retention rod is in the form of an eyelet for use with a means for locking the ladder in place.

13. A structural system including means for protecting a gutter of a building structure, having a roof and a fascia board, against deformation when a ladder is used for access to the roof of said structure, said device comprising:

a) a fascia board of a building structure;

b) a gutter attached to said fascia board, said gutter having a back side fastened to said fascia board, an opposing front side, a bottom side, and an open top;

c) a ladder support comprising a frame attached to said fascia board and positioned inside the said gutter in a longitudinal plane substantial even with a plane of the open top of said gutter, said frame having two side legs, and a front leg positioned inside the front side of said gutter, for supporting said gutter against deformation by aid ladder, each of said side legs having a longitudinal passageway therethrough adapted to receive a spike or screw for fastening said side legs to said fascia board in a plane substantially even with the plane of the open top of said gutter, and each of said side legs having spurs extending beyond free ends thereof for preventing slippage of said ladder when it is in place between said spurs;

d) each of said spurs having at least one aperture in its free end for receiving a retention rod having two ends for preventing the ladder from falling away from said structure, and said spurs having slots for storing said retention rod when not in use; and e) said retention rod having a key nub at one end and said apertures in the said free ends of said spurs having key raceways which can mate with said key nub, so that said retention rod can be inserted in said apertures and locked in place by turning said rod.

14. The structural system of claim 13 wherein an end of said retention rod opposite said key nub is equipped with a handle and said retention rod is locked in place by the force of gravity on said handle.

15. The structural system of claim 13 wherein each of said spurs has at least two spaced apart apertures for receiving said retention rod at varying positions to accommodate ladders of differing thickness.

16. The structural system of claim 13 wherein said key nub on said retention rod is in the form of an eyelet for use with a means for locking said retention rod in place.

* * * * *